US006782627B2

(12) United States Patent
Hermes et al.

(10) Patent No.: US 6,782,627 B2
(45) Date of Patent: Aug. 31, 2004

(54) CHAIN SAW

(75) Inventors: Christian Hermes, Sebnitz (DE); Siegfried Keusch, Deizisau (DE)

(73) Assignee: Robert Bosch GmbH, Stuttgart (DE)

( * ) Notice: Subject to any disclaimer, the term of this patent is extended or adjusted under 35 U.S.C. 154(b) by 69 days.

(21) Appl. No.: 09/914,367

(22) PCT Filed: Dec. 5, 2000

(86) PCT No.: PCT/DE00/04333

§ 371 (c)(1),
(2), (4) Date: Aug. 27, 2001

(87) PCT Pub. No.: WO01/49465

PCT Pub. Date: Dec. 7, 2001

(65) Prior Publication Data

US 2002/0124421 A1 Sep. 12, 2002

(30) Foreign Application Priority Data

Dec. 29, 1999 (DE) ..... 199 63 650

(51) Int. Cl.[7] ..... B27B 17/14
(52) U.S. Cl. ..... 30/386; 83/816
(58) Field of Search ..... 30/385, 386; 83/814, 83/816

(56) References Cited

U.S. PATENT DOCUMENTS

| | | | | | |
|---|---|---|---|---|---|
| 3,636,995 | A | * | 1/1972 | Newman | 30/386 |
| 4,129,943 | A | * | 12/1978 | Bricker | 30/386 |
| 5,174,029 | A | * | 12/1992 | Talberg | 30/386 |
| 5,491,899 | A | * | 2/1996 | Schliemann et al. | 30/386 |
| 5,896,670 | A | | 4/1999 | Gibson et al. | |
| 6,049,986 | A | * | 4/2000 | Calkins et al. | 30/386 |
| 6,532,671 | B1 | * | 3/2003 | Jong | 30/386 |
| 6,564,459 | B1 | * | 5/2003 | Steinbrueck et al. | 30/383 |

FOREIGN PATENT DOCUMENTS

| | | | |
|---|---|---|---|
| CH | 294418 | * | 1/1954 |
| DE | 2 132 747 | | 2/1972 |
| DE | 42 20 845 A | | 1/1994 |
| DE | 44 36 543 A | | 5/1995 |
| DE | 199 31 250 A | | 1/2001 |
| GB | 578 825 A | | 7/1946 |
| WO | 98/33631 | | 8/1998 |

* cited by examiner

*Primary Examiner*—Stephen Choi
(74) *Attorney, Agent, or Firm*—Michael J. Striker

(57) ABSTRACT

The chain tension of a motorized chainsaw (10) with a housing (12), a sprocket (22) mounted thereon, and a blade (14) that is aligned with this sprocket, which blade protrudes beyond the housing (12) and guides a saw chain (16) engaged with the sprocket (22) in a revolving manner, where the blade (14) is mounted such that it can be adjusted by means of longitudinal displacement in relation to the housing (12) and/or the sprocket (22) by means of a chain tensioning device (28) and where the chain tensioning device (28) has a stop (32) that can be fixed to the blade (14) and a cam (30) that can be rotated by means of a rotational member (36, 38) can be adjusted in a more comfortable and reliable fashion by virtue of the fact that the cam (30) can be locked in a form-fitting and rotationally secure manner in relation to the housing (12) by way of the rotational member (36, 38).

8 Claims, 9 Drawing Sheets

Fig. 4
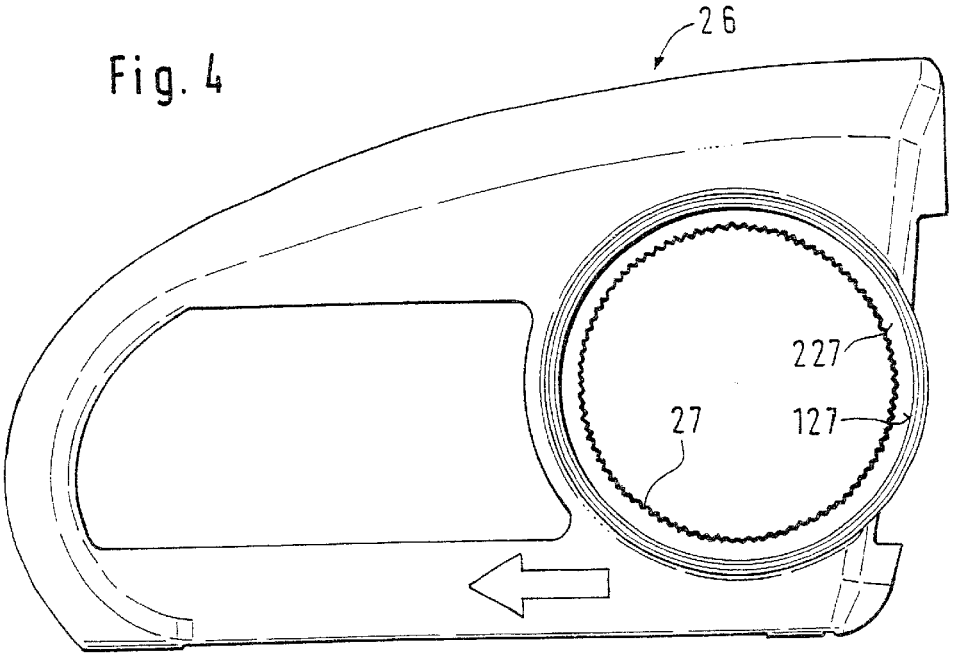
Fig. 5
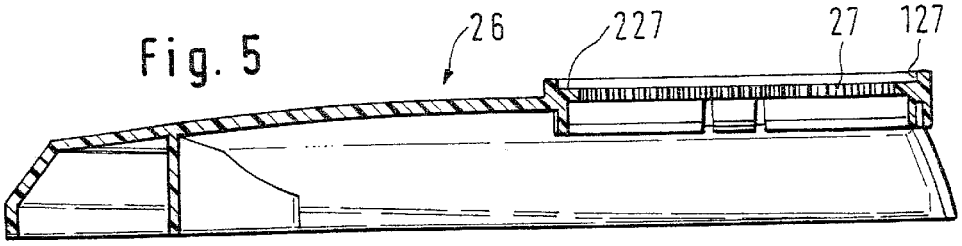
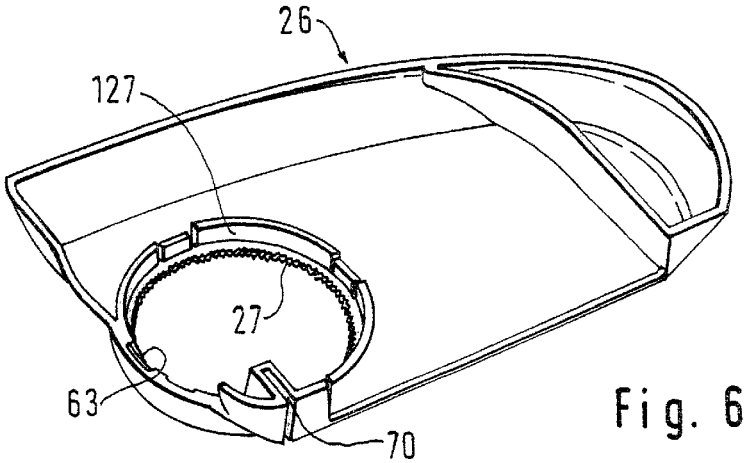
Fig. 6

CHAIN SAW

BACKGROUND OF THE INVENTION

The invention relates to a chainsaw.

DE-A1 21 327 47 discloses a generic chainsaw in which, between a rotational member and a cam, a pre-stressed torsion spring is disposed that seeks to rotate the cam resting against the stop in such a rotational direction that the blade is constantly subjected to a displacement force in the longitudinal direction. In this manner, the blade is kept at the greatest possible distance from the sprocket. This causes a tension force to constantly act on the saw chain, compensating for an increase in the length of the saw chain resulting from wear and temperature influences during operation.

During assembly, the torsion spring is tensed by means of the rotational member, which is embodied as a turning knob, until the cam rests against the stop with sufficient pre-tension, thus achieving the optimal chainsaw tension.

In a chainsaw with a chain tensioning device known from WO 98/33631, the blade is fixed between two securing plates and, together with these plates, is secured in a longitudinally movable fashion to the housing. A bolt, which extends through a bore in one cam and an oblong hole in the housing, is screwed into the one holding plate, which is guided on the housing in a longitudinally moveable manner, and fixes the cam to the housing by means of its bolt head. For the purpose of tensing the saw chain, the bolt is loosened and the cam is rotated so that the bolt, together with the holding plate, is moved in the direction of the blade tip. The rotation of the cam should be stopped once the saw chain has attained the desired tension. The bolt must then be tightened again so that the cam and the holding plates, together with the blade, are fixed to the housing in a frictional, non-positive fashion in the set position.

The known embodiments for tensing the saw chain are relatively expensive and involve the danger that the positional locking of the blade may slacken, with the chain tension decreasing as a result. This increases the danger that the saw chain may fly off the blade. This can only be prevented by frequently retensioning the chain.

SUMMARY OF THE INVENTION

The chainsaw according to the invention, has the advantage that a position of the blade in relation to the sprocket selected by the chainsaw user can be secured in a form-fitting fashion and only has to be readjusted if the chain has lengthened as a result of wear or if the blade and the sprocket and/or the deflection wheel have been worn down. Here, the chain tensioning device can be operated manually without any tools. For this purpose, it is merely necessary tl alternately rotate two handwheels that are disposed concentrically and Immediately adjacent to one another, each in the same direction. An automatic slackening of the chain pre-stressing device with the result of decreasing chain tension during operation of the chainsaw is reliably prevented by ability to the positionally lock the cam disc in a form-fitting fashion by means of the handwheels because the blade is thus held fixed in the set tension position.

By virtue of the fact that the rotational member is comprised of two shell-like handwheels that can be slid one into the other and rotated in relation to one another around a common axis, a convenient operation is produced with which the saw chain can be tensed without tools using one hand, in a "blind" fashion, i.e. without the user having to search for the control elements.

By virtue of the fact that the inner handwheel can be axially displaced in relation to the housing and can be supported on the blade, the blade can be locked in a definite position, i.e. without the possibility of user error, particularly after the chain tension has been set to the desired value beforehand using the outer handwheel.

By virtue of the fact that the outer handwheel is coupled to the cam in a rotation-transmitting manner, in particular by way of an internal spline/external spline connection, a secure transmission of rotation to the cam is assured, with the connection between the outer handwheel and the cam being particularly simple to produce and assemble, due to the fact that it can have coarse tolerances.

By virtue of the fact that the cam is mounted so that it can be moved axially and elastically in relation to the housing and/or the handwheel, after the cam has been rotated a maximum of three-quarters of a rotation, it locks into its working position in relation to a stop plate drive-connected to the blade. In this manner, the assembly of the chain tensioning device is simple and safe from user error, e.g., after the saw chain has been changed.

By virtue of the fact that the outer handwheel can, by way of a detent coupling, be coupled to the housing, in particular to the sprocket cover, an undesired change in the saw chain tension during the adjustment process is prevented.

By virtue of the fact that the detent coupling is preferably embodied as a radial detent coupling, the rotational position of the outer handwheel can be locked with the greatest possible locking action. In this instance, this locking position can be established in a form-fitting fashion by means of the inner handwheel in such a way that it cannot be changed unintentionally during operation of the chainsaw.

By virtue of the fact that the inner handwheel can be coupled to the outer handwheel in a detachable fashion by way of an axial detent coupling, the inner handwheel can also be secured in a non-rotational fashion, thus preventing the unintentional release of the axial locking of the blade as well as of the chain tensioning device.

By virtue of the fact that spring means seek to press the inner handwheel and the outer handwheel axially apart from each other, in particular spring means disposed axially between the two handwheels, the blade position is secured when the inner handwheel is loosened without the outer handwheel rotating along with it in an undesired manner and thereby reducing the selected saw chain tension.

By virtue of the fact that the spring means seek to press the cam and the inner handwheel axially apart from each other, in particular spring means disposed axially between the cam and the inner handwheel, the chain tensioning device can form a complete structural unit that can be preassembled in captive fashion, in particular along with the sprocket cover, and can be connected to the housing without errors in assembly.

By virtue of the fact that an inner protective cover closes the chain tensioning device from the inside at the sprocket cover, dust and shavings are prevented from penetrating into the chain tensioning device and thus impairing its function.

By virtue of the fact that the chain tensioning device has an elongated, angular stop plate for gripping the cam, which can be fixed to the blade, the stop plate is particularly resistant to deformation and bending while using a particularly small amount of material, so that the chainsaw is lighter and the chain tensioning device operates in a more directly responsive manner than is the case with known U-shaped stop plates.

BRIEF DESCRIPTION OF THE DRAWINGS

The invention will be explained in greater detail in the following description in conjunction with an exemplary embodiment and associated drawings.

FIG. 4 is a top view of the sprocket cover, FIG. 5 is a longitudinal section through the sprocket cover, FIG. 6 is a three-dimensional bottom view of the sprocket cover.

DESCRIPTION OF THE PREFERRED EMBODIMENTS

Figure 1:
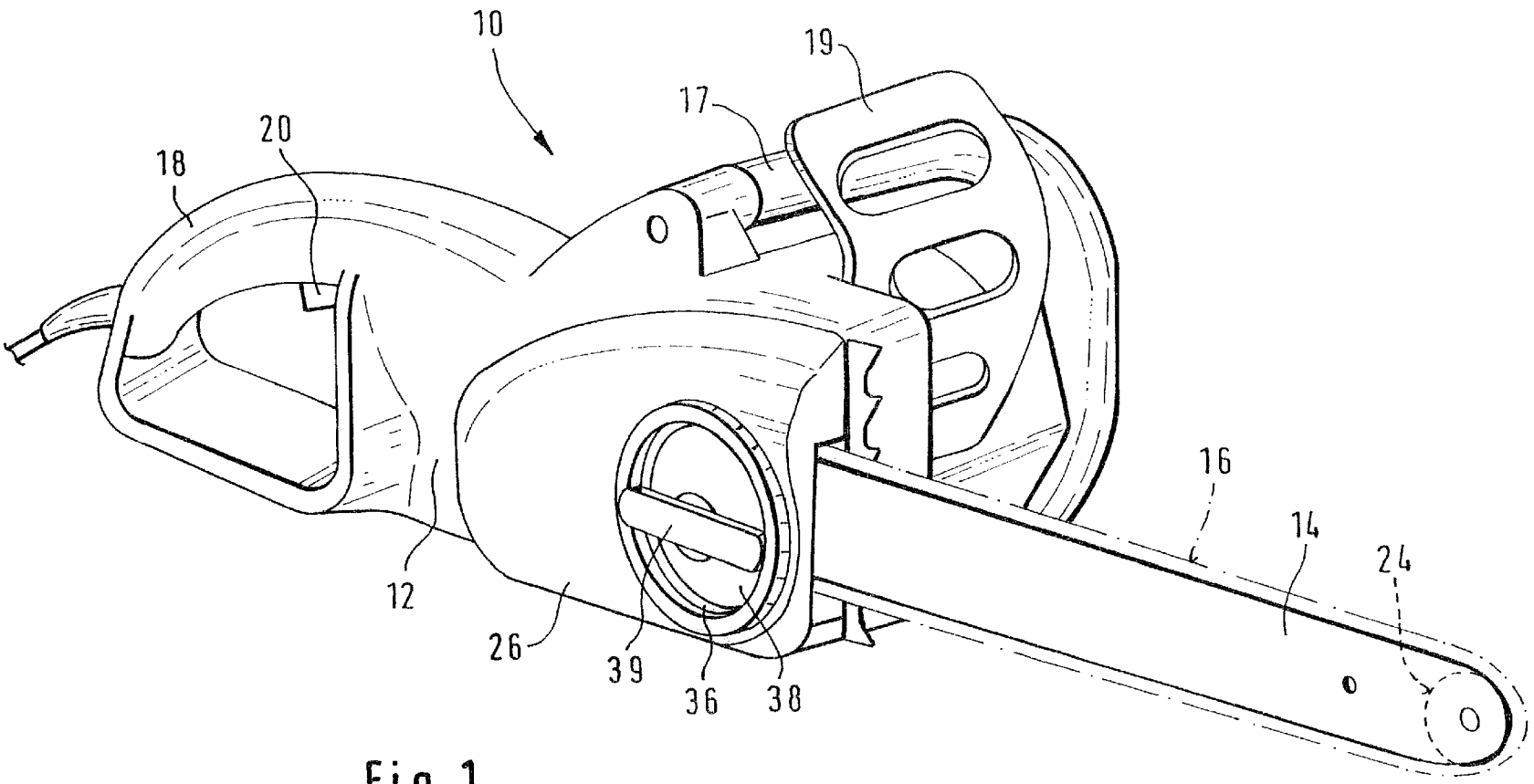
FIG. 1 is a three-dimensional front view of a chainsaw.

FIG. 1 shows a three-dimensional depiction of the chainsaw 10 with a housing 12 from the front of which a blade 14 protrudes, which is encompassed by a saw chain 16 that is guided to revolve on the blade. The housing 12 has a grip 18 with a switch 20 for switching on the motor, not shown, an additional hand grip 17 for guiding the chainsaw 10 with the user's second hand, and a brake actuation button 19 for quickly switching off the saw chain drive, in particular in the event of a dangerous kickback.

The chainsaw 10 supports a sprocket cover 26 on its side that contains a chain tensioning device (FIGS. 2, 3), of which an outer handwheel 36 and an inner handwheel 38 with a grip 39 are visible. A sprocket 22 (FIGS. 2, 3, 17) is disposed underneath the sprocket cover 26 on the side of the housing, onto which sprocket the saw chain 16 is to be placed in such a way that a form-fitting engagement is produced between the two components and the chain 16 is driven to revolve when the sprocket 22 is rotated. The sprocket 22 is drivably coupled to an internal combustion or electric motor by way of a transmission, not shown.

At its tip, the blade 14 has a deflection wheel 24 by way of which the saw chain 16 is deflected, secured against loss, and held on the blade 14 in a form-fitting fashion.

Figure 2:
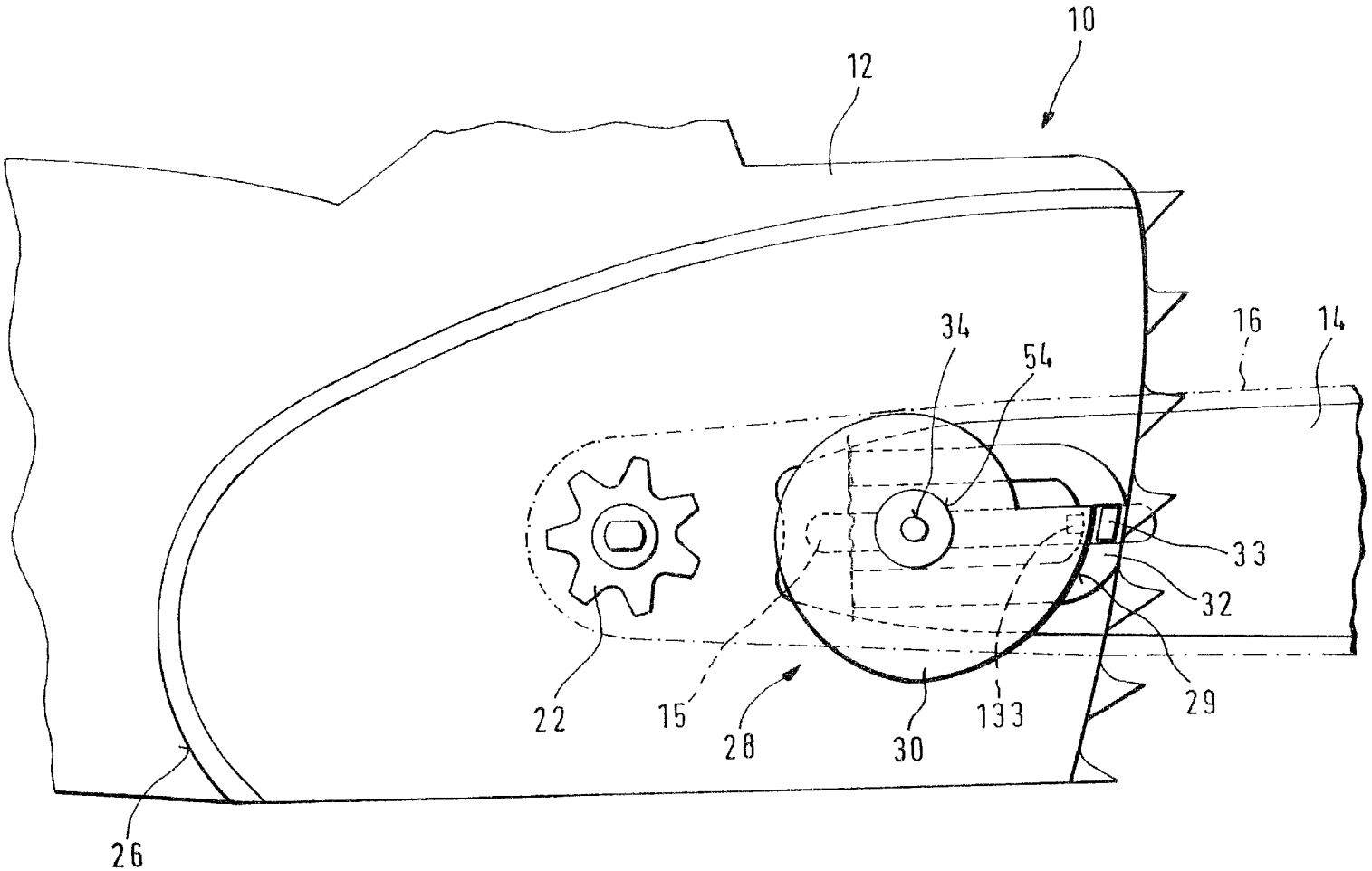
FIG. 2 is a side view of the chainsaw in the region of the chain tensioning device with the protective cover removed.

FIG. 2 shows a side view of the chainsaw 10 in the region of the chain tensioning device 28 when the sprocket cover 26, whose outer contour is indicated by a double line 26, is removed. Here, the sprocket 22 is shown in a top view and the saw chain 16 that is guided over the sprocket 22 and the blade 14 is represented by a dot-and-dash line.

The blade 14 is held in the region of its oblong hole 15, laterally pressed against the housing. In this instance, for the purpose of securing the position of the blade, a longitudinal protrusion, not shown, on the side of the housing juts into the oblong hole 15. Also, a stay bolt 34 passes through the oblong hole 15 approximately in the middle and reaches past the front flat side of the blade 14.

A spacer disc 54 of the chain tensioning device 28 concentrically encompasses the stay bolt 34 and is supported laterally on the blade 14. In so doing, it overlaps the lateral diameter of the oblong hole 15 and presses the blade 14 laterally against the housing 12 by means of corresponding axial prestressing of the chain tensioning device 28 (FIG. 3), prevents the blade from moving in the longitudinal direction.

A cam disc 30 with a spiral outer contour is clearly discernible. Using this cam disc, the longitudinal position of the blade 14 can be securely adjusted in relation to the housing 12. An annular stop plate 32 (FIGS. 17, 18), which is shown in a cut-away fashion in the region of its legs and is disposed between the blade 14 and the cam disc 30, serves as a coupling means. On the one side, the stop plate 32 is secured to the blade in a fixed manner due to the fact that a protruding holding tab 133 engages with the blade 14. On the other side, a support tab 33 protruding laterally toward the other side comes into contact with the circumference with the spiral outer contour of the cam disc 30 so that the cam disc 30 thus determines the position of the stop plate 30 and thus the position of the blade 14.

Thus, the distance between the blade 14 and the sprocket 22 can be changed by means of the ability of the blade 14 to be longitudinally displaced so that the saw chain 16 can have more or less tension exerted on it.

In order to tense the saw chain 16 and in order to fix the blade 14 in a position that will maintain the desired chain tension, the chain tensioning device 28 is disposed in the protective hood-like sprocket cover 26 (FIGS. 3, 4), which can be attached to the housing 12. The chain tensioning device 28 contains the cam disc 30, which is rotatably mounted on the sprocket cover 26, with its spiral outer contour and a rotational member (FIG. 3) embodied as an outer and inner handwheel 36, 38 for rotating the cam disc 30. The rotational connection here between the outer handwheel 36 and the cam disc 30 is embodied as an internal spline/external spline coupling 31/37.

By rotating the outer handwheel 36 with the cam 30, the blade 14 can be moved toward the blade tip in such a way that the distance to the sprocket 22 is increased, as a result of which increasing tension is exerted on the saw chain 16. If the saw chain 16 has come to rest entirely along the longitudinal edge of the blade 14 and is tensed, the rotational resistance on the outer handwheel 36 increases. This wheel should now continue to be rotated in detent fashion in a sensitive and controlled manner until the desired chain tension is actually attained. Then, the inner handwheel 38 should be finally screwed into place axially toward the housing 12 on the stay bolt 34. In so doing, it loads and clamps the blade 14 axially into the desired position.

Figure 3:
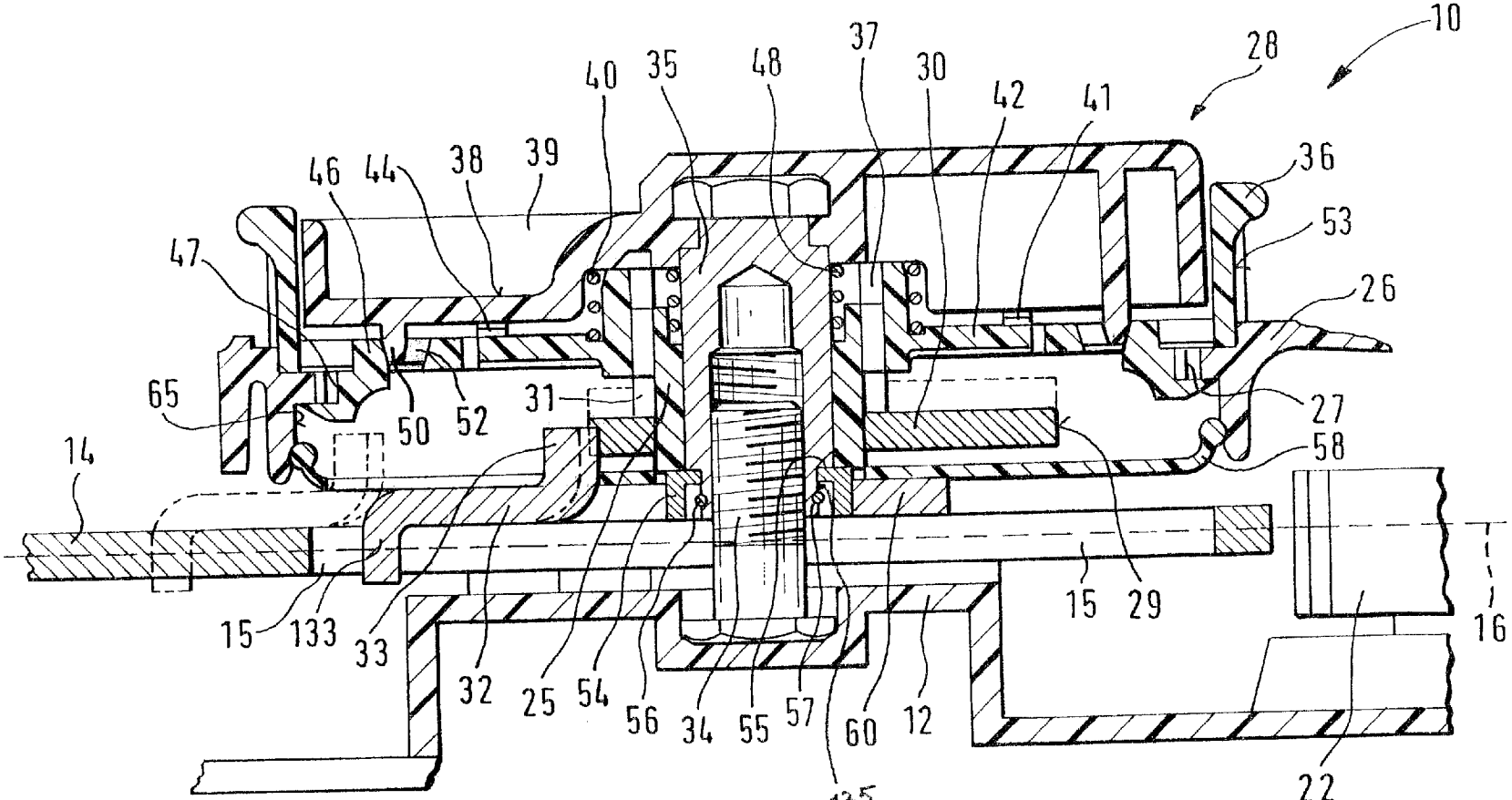
FIG. 3 is a horizontal cross section through the chainsaw in the region of the chain tensioning device.

FIG. 3 shows a horizontal longitudinal section through the chainsaw 10 in the region of the chain tensioning device 28 with a stay bolt 34 anchored in the housing 12, with its hexagonal head in a housing wall, not shown in detail, which has a metallic internally threaded piece 35 screwed onto it. This internally threaded piece is a cylindrical part with a smooth exterior and a central blind hole, not shown in detail, with an internal thread, which is anchored in a plastic inner handwheel 38 with its hexagonal head, not shown in detail, in a non-rotational and captive fashion. On its free end, the internally threaded piece 35 supports the spacer disc 54 in captive fashion, by way of which it is axially supported on the flat side of the blade 14 and, at the same time, clamps this blade laterally to the housing 12.

The spacer disc 54 has a stepped collar 55 that surrounds a stepped diameter 135 of the free end of the threaded piece 35 with its inner diameter and in so doing, is supported axially and to the rear on the end of the stepped diameter 135. The spacer disc 54 is secured against loss with axial play by means of a securing ring 56 that rests in a recess 57 at the end of the threaded piece 35.

On its exterior, the female threaded piece 35 supports a cam disc 30, which can be moved between the inner handwheel 38 and the spacer disc 54, and to this end, passes through its hollow, cylindrical, hub-like plastic inner piece 25.

Between the cam disc 30 and the inner handwheel 38, a smaller, pre-stressed helical spring 48 concentrically encompasses the internally threaded piece 35 and seeks to push the cam disc 30 and the inner handwheel 38 axially apart each other.

On its outer circumference, the hub-like inner piece 25 of the cam disc 30 is embodied as an internal spline 31. This shaft is radially surrounded by the external spline 37 of the outer handwheel 36 and is thus held in an axially movable but rotationally secured fashion.

The cam disc 30 is secured in place in a non-rotational and axially immobile fashion in relation to the lower end of the hub-like part 25. With its spiral, radial stop surface 29, the cam disc 30 is supported on the lateral support tab 33 of the stop plate 32. The stop plate 32 is fixed to the flat side of the blade 14 in captive fashion by way of a screw connection. In addition, with a holding tab 133 protruding laterally in the direction of the blade 14, the stop plate 32 engages in the oblong hole 15 of the blade 14 and is supported in this oblong hole at its front edge. If the stop surface 29 of the cam disc 30 is rotated in relation to the support tab 33, the stop plate 32 will, as a result, be moved more or less forward in the longitudinal direction along with the blade 14 in accordance with the eccentricity of the cam disc 30 and the saw chain 16 guided over the blade 14 will thus be tensioned more or less tightly depending on how the distance changes between the blade 14 and the sprocket 22, which is shown on the right in the present view.

The stop plate 32 is embodied as an elongated annular sheet metal part (FIGS. 17, 18) and has two longitudinal legs 60, 160 that symmetrically encompass the circumference of the spacer disc 54 and the stay bolt 34.

The outer handwheel 36 is secured to the sprocket cover 26 in an axially immobile but rotatable fashion. This cover has a hollow toothed wheel 27 embodied of one piece, which the handwheel 36 penetrates and engages from below. This occurs by means of three toothed segments 47 that are incorporated into the ends of three radial flexible tongues 46 in the flat base of the shell-like outer handwheel 36, which is composed in particular of red plastic. The toothed segments 47 each have an outer toothing that fittingly engages the teeth, not shown in greater detail, on the hollow toothed wheel 27 and lock in place there by pushing radially outward in a pre-stressed fashion. A radial detent coupling is thus produced, which is effective in every rotational direction of the outer handwheel 36 with distinctly tangible detent resistance.

The inner handwheel 38 is inserted centrally into the shell-like outer handwheel 36. With an axially protruding annular collar 50, it engages in an axial ring groove 52 of the outer handwheel 36. In so doing, the edge of the annular collar 50 contacts the flexible tongues 46, particularly in the region of the toothed segments 47, and presses them radially outward. The more the inner handwheel 38 approaches the outer handwheel 36 axially, the farther the annular collar 50 moves the toothed segments 47 radially outward such that it is held and pressed with greater force against the toothing of the hollow toothed wheel 27 of the sprocket cover 26. As a result, the outer handwheel 36 is locked in a non-rotational fashion in relation to the sprocket cover 26, with the inner handwheel 38 being loaded in an axially pre-stressed fashion in relation to the outer handwheel 36 by means of the helical spring 40 disposed between them.

An axial detent coupling is disposed between the outer handwheel 36 and the inner handwheel 38. This coupling is composed of axial toothed segments 41 belonging to axially displaceable spring tabs 42 that are cut out of the base of the shell-like outer handwheel 36 and are supported against a face toothing 44 of the inner handwheel 38. This axial detent coupling 41, 42, 44, when in the detent position, holds the inner handwheel 38 against the outer handwheel 36 in a fixed manner, preventing an unintentional loosening.

The inner handwheel 38 has a central grip 39 that protrudes axially and permits the inner handwheel 38 to be comfortably gripped and rotated.

An inner protective cover 58 prevents dirt and shavings, which are carried along by the saw chain 16 during sawing, from entering the chain tensioning device 28. This protective cover is fixed inside the sprocket cover 26 by engaging with a collar-like area in an axially locking fashion.

The chain tensioning device 28 functions as follows: For the purpose of releasing the blade 14, the inner handwheel 38 is first turned counterclockwise until the axial detent coupling 41, 42, 44 tangibly and audibly disengages from the outer handwheel 36. The disengaging is encouraged by the helical spring 40, which seeks to push the detent coupling 41, 42, 44 apart. In so doing, the annular collar 50 moves axially away from the toothed segments 47 and releases them. They can then move out of the way in a radially inward direction, thereby allowing the detent rotation of the outer handwheel 36.

The chain tensioning device 28 is adjusted and/or dimensioned in such a way that the clamped locking of the blade 14 is released by means of the inner handwheel 38 when the detent coupling 41, 42, 44 is disengaged. Then the spacer disc 54 and/or the internally threaded piece 35 have a sufficient axial distance from the blade 14. After this, its longitudinal mobility is impaired by only the cam disc 30. This locking is released by the subsequent rotation of the outer handwheel 36 and the rotational sympathetic motion in the same direction of the cam disc 30 in the slackening direction. Through rotation in the slackening direction, the eccentricity of the spiral radial stop surface 29 becomes ever smaller in relation to the support of the blade 14. The blade 14 can consequently be moved toward the sprocket 22, to the right in the direction of the drawing, whereupon the saw chain tension is reduced.

In order to tension the saw chain 16, at first the same procedure is performed as for slackening the saw chain 16 except that, when the detent coupling 41, 42, 44 is disengaged, the outer handwheel 36 should be rotated counter to the rotational direction for slackening. In this manner, the blade 14 is moved to the right in the direction of the drawing (FIG. 17), away from the sprocket 22 and the saw chain is pulled tighter. If the desired saw chain tension is attained, the inner handwheel 38 should be turned clockwise until the detent coupling 41, 42, 44 is again engaged and the handwheel 38 cannot be rotated any further.

In this position, the chain tensioning device 28 axially fixes the sprocket cover 26 without play to the housing 12 of the chainsaw 10 and to the stay bolt 34, and secures this sprocket cover against loss.

Moreover, the sprocket cover 26 is secured against rotating in relation to the housing 12 by means of a narrow slot 70 that engages in a play-free fashion with a tongue 68 that is fastened to the housing 12 and protrudes laterally in the direction of the sprocket cover 26.

In order to detach the sprocket cover 26 together with the chain tensioning device 28, for example, for the purpose of changing the saw chain 16, the inner handwheel 38 is rotated in the slackening direction until the internally threaded piece 35 has been completely released from the stay bolt 34. Subsequently, the sprocket cover 26 can be moved axially away from the housing 12 by pulling on the inner handwheel 38. Then the cam disc 30 also no longer moves out of contact with the stop plate 32. After this, the blade 14 is neither axially secured nor secured against longitudinal displacement and can be removed axially from the housing 12 and/or from the sprocket 22 past the stay bolt 34.

FIG. 4 shows the sprocket cover 26 in a top view, the hollow toothed wheel 27 being shown as a larger opening in the sprocket cover 26, against whose outer flat side 227 the outer handwheel 36 is axially supported with its flat underside and this outer handwheel can be engaged from the rear with its toothed segment 47 protruding radially. In order to contain the handwheels 36, 38, the sprocket cover 26 has a shell-like edge 127 into which the outer handwheel 36 is inserted.

FIG. 5 shows the sprocket cover 26 in a longitudinal section; previously mentioned details can be discerned without the reference numerals needing to be mentioned again.

FIG. 6 shows a bottom view of the sprocket cover 26 and a detent tab 63 on the collar 127, which serves to lock the inner protective cover 58 (FIG. 3) in detent fashion.

Figure 7:
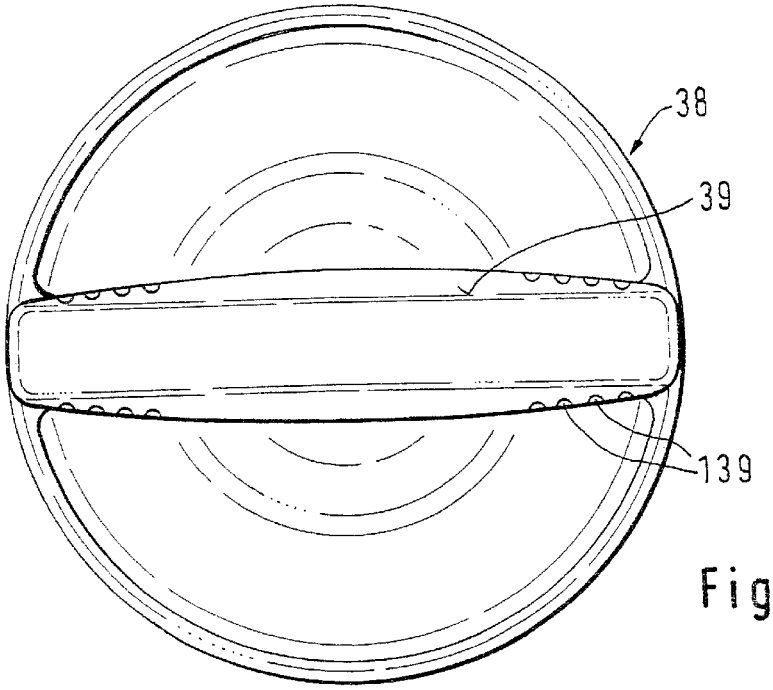
FIG. 7 is a top view of the inner handwheel.

FIG. 7 shows a top view of the inner handwheel 38, with the grip 39 with lateral ribs 139 being discernible, which allow a slip-free gripping and handling.

Figure 8:
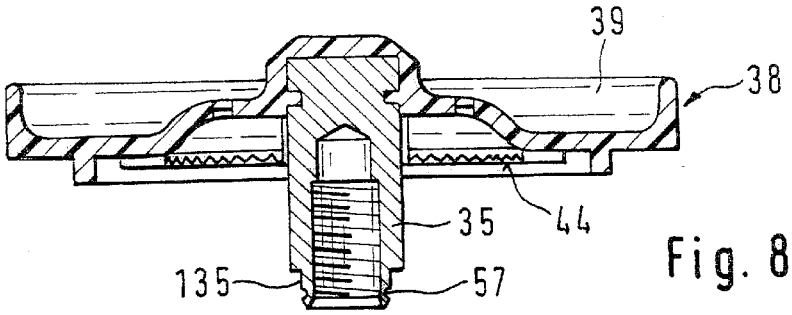
FIG. 8 is a cross section through the inner handwheel.

FIG. 8 shows a cross section through the inner handwheel 38 with the metallic internally threaded piece 35, whose small stepped diameter 135 has an annular groove-like recess 57 for containing a securing ring 56 (FIG. 3).

Moreover, an axial toothing with opposing face teeth 44 shown on the underside of the plastic shell-like part of the inner handwheel 38, which teeth form the axial detent coupling 41, 42, 44 in combination with the axial tooth segments 41 of the outer handwheel 36 (FIGS. 3, 11), which secure the inner handwheel 38 against rotating in relation to the outer handwheel 36 and prevent an undesired loosening of the chain tensioning device 28.

Figure 9:
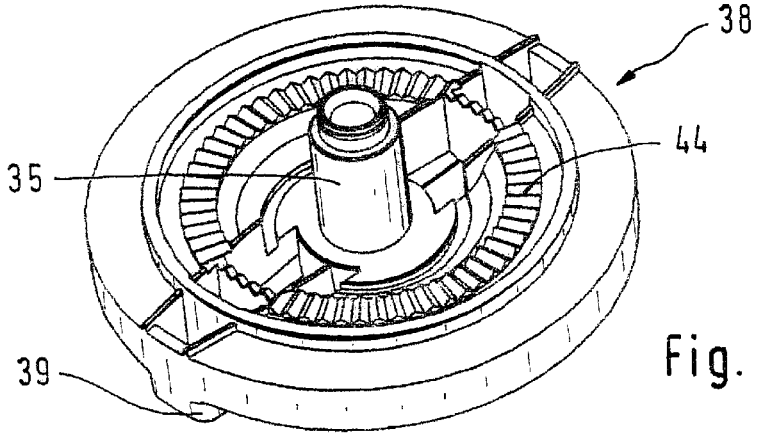
FIG. 9 is a three-dimensional bottom view of the inner handwheel.

FIG. 9 shows a three-dimensional representation of the inner handwheel 38 from below, in which the previously mentioned details from FIGS. 7 and 8 can been clearly seen without it being necessary to repeat them in detail.

Figure 10:
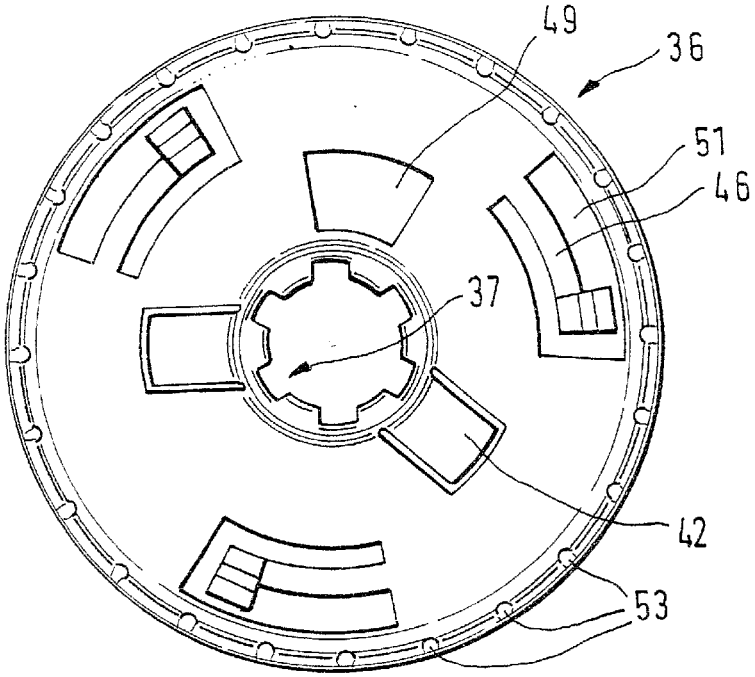
FIG. 10 is a bottom view of the outer handwheel.

FIG. 10 shows a bottom view of the outer shell-like handwheel 36 that has a knurling 53 on its outer edge facing upward to make it easier to manipulate.

The outer handwheel 36 has a number of cut-outs in its shell-like base. In the radially outer region, they are embodied as radially and axially elastic, bow-shaped flexible tongues 46, each of which has a toothed segment 47 with two teeth on its outer end. Three more symmetrically distributed additional cutouts are provided further inward in the radial direction. Two of these form neighboring, axially movable spring tabs 42, with the third being a recess 49. The end of each of the spring tabs 42 that reach radially outward has an axial toothed segment 41 for engaging the opposing face teeth 44 of the inner handwheel 38, which jointly comprise the detent coupling 41, 42, 44 described in conjunction with FIG. 3. The third recess 49 between those of the spring tabs 42 forms a window through which any dust or shavings that can collect between the inner and outer handwheels 36, 38 can escape.

The middle of the outer handwheel 36 forms an external spline 37 formed in the shape of a collar to which the internal spline 31 of the cam disc 30 can be drive-connected in a rotationally secured fashion and can be mounted such that it can be moved back and forth in the axial direction.

Figure 11:
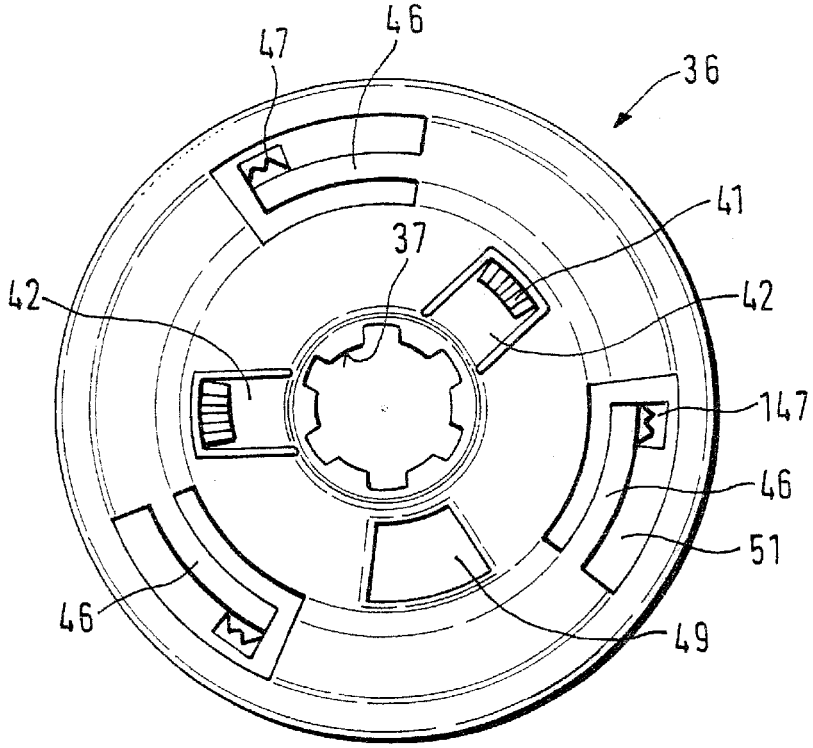
FIG. 11 is a top view of the outer handwheel.

FIG. 11 shows a top view of the outer handwheel 36, with the toothed segments 47 being discernible with their teeth 147 pointing radially outward, which serve to engage the toothing of the hollow toothed wheel 27 and form the radial detent coupling between the outer handwheel 36 and the sprocket cover 26.

The top view of the axial toothed segments 41 makes it clear that the spring tabs 42 supporting them are embodied in the manner of leaf springs and can flex in the axial direction.

Figure 12:
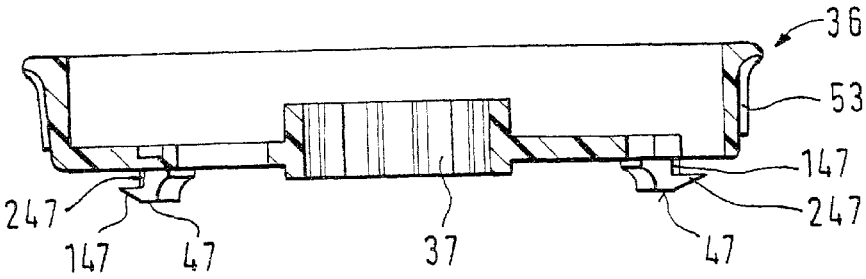
FIG. 12 is a cross section through the outer handwheel.

FIG. 12 shows a cross section through the outer handwheel 36, that shows its external knurling 53, the external spline 37, and the embodiment of the radial toothed segments 47 with the radial teeth 147 as well as radial protrusions 247 that each serve to engage under the hollow toothed wheel 27 of the sprocket cover 26. The shell-like embodiment of the outer handwheel 36 for containing the inner handwheel 36 is also shown.

Figure 13:
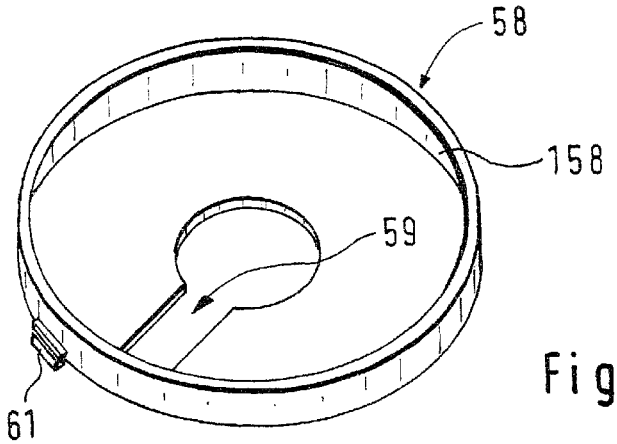
FIG. 13 is a three-dimensional bottom view of the inner protective cover.

FIG. 13 shows a bottom view of the inner protective cover 58 with a raised lateral edge 158 and a keyhole-like large through opening 59 to allow the internally threaded piece 35 and the spacer disc 54 to pass through, where the elongated section of the through opening 59 permits the support tab 33 of the stop plate 32 to pass through.

On its outer edge, the protective cover 58 has a locking projection 61 protruding from it, which is associated with the detent tab 63 of the sprocket cover 26 and permits the protective cover to be mounted in the correct position in relation to the sprocket cover 26.

Figure 14:
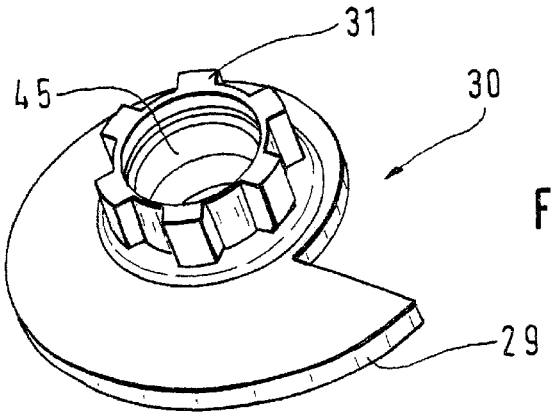
FIG. 14 is a three-dimensional view of the cam disc.

FIG. 14 shows a three-dimensional depiction of the cam disc 30, with its metal, flat, disc-like region with the eccentric radial stop surface 29 being particularly discernible. An injection molded central collar-like part made of plastic supports the internal spline 31. The internal spline 31 has a central axial bore 45 to allow the internally threaded piece 35 to pass through (FIG. 3).

Figure 15:
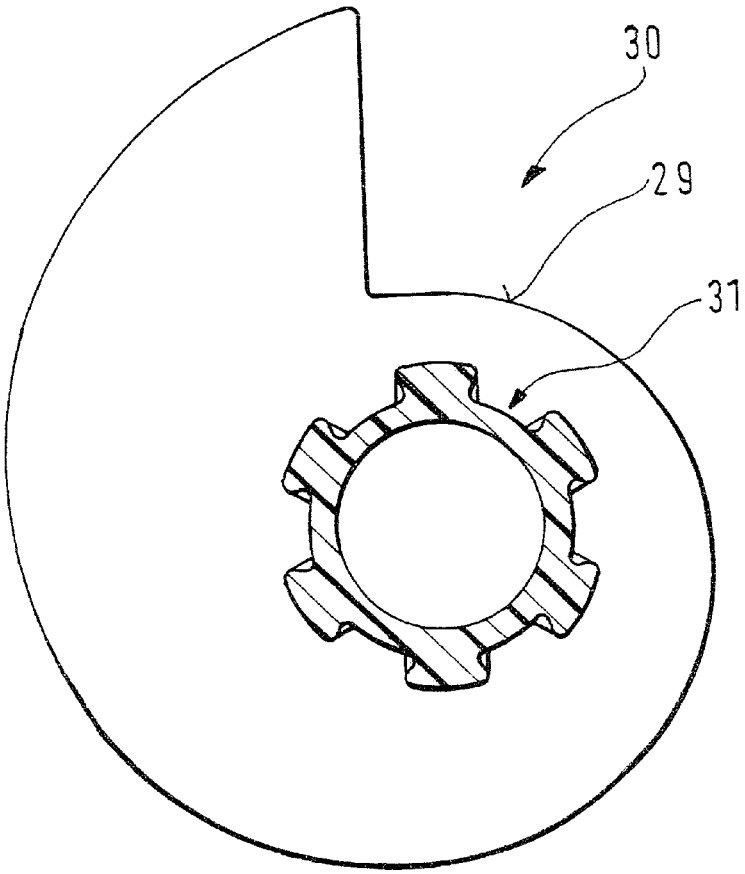
FIG. 15 is a top view of the cam disc.
Figure 16:
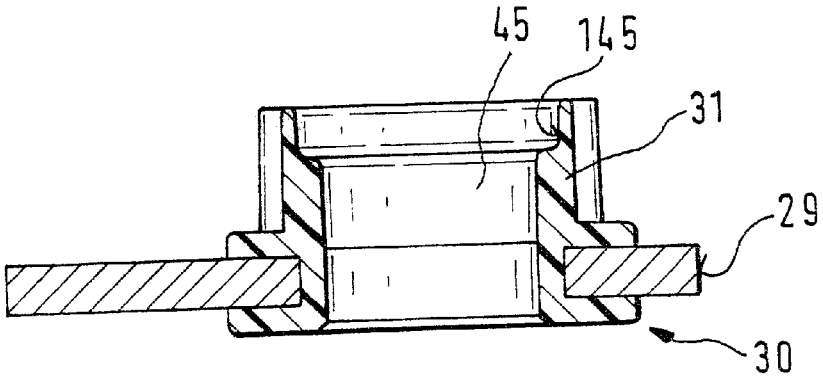
FIG. 16 is a cross section through the cam disc.

FIGS. 15, 16 respectively show a top view and a cross section of the cam disc 30, depicting particularly clearly the embodiment of the internal spline 31 which encompasses the flat region of the cam disc 30 in an axially and radially non-rotational manner.

FIG. 16 clarifies the embodiment of the stepped collar 145 and a stepped bore that widens toward the top, in the upper region of the axial bore 45, which serves to contain and support the smaller helical spring 48 (FIG. 3) for axially holding the cam disc 30.

Figure 17:
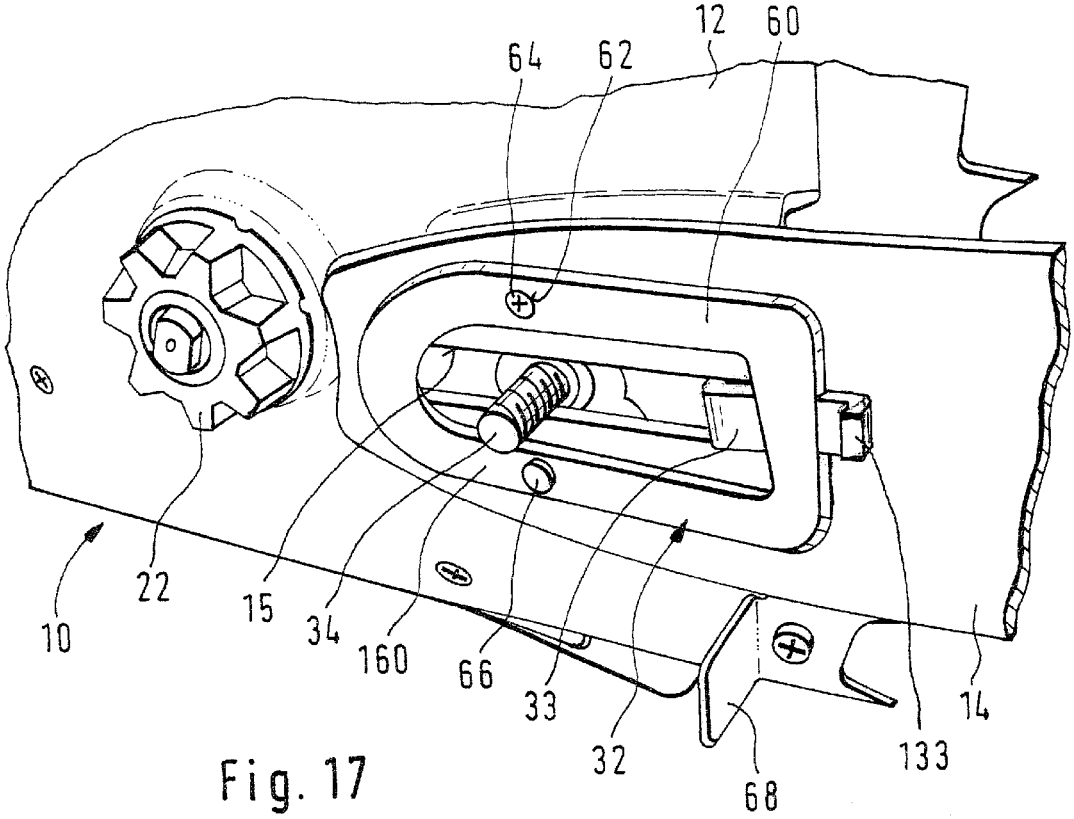
FIG. 17 is a side view of the chainsaw in the region of the saw chain tensioning device with the blade and stop plate.

FIG. 17 shows a three-dimensional top view of the chainsaw 10 with the sprocket cover 26 (FIGS. 1 and 4) removed, where the sprocket 22 and the blade 14 in its disposition against the flat side of the housing 12 are shown and in particular, the disposition of the annular stop plate 32 laterally on the blade 14 by means of a screw 43 that is screwed through the blade 14 at the rear and passes through an appropriately sized threaded hole in the lower leg 60 of the U-shaped stop plate 32. The stop plate 32 is thus fixed on the blade 14 in captive fashion. Furthermore, the stop plate 32 passes through the oblong hole 15 of the blade 14 with a holding tab 133 and is thus longitudinally supported at its front end in relation to the blade 14. In this manner, the initial stress and/or displacement force of the cam disc 30 transmitted by way of the support tab 33 can be reliably transferred to the blade 14. Due to the annular embodiment, the stop plate 32 is a particularly stable and deformation-resistant component.

In the upper leg 160 of the stop plate 32, a round protrusion 66 pointing toward the blade 14 is stamped laterally into the end of the stop plate and serves to seal an oil bore passing laterally through the blade 14, which is supplied with lubricating oil by way of channels, not shown, from the inside of the housing 12, which oil seeps into the blade 14 and, once there, travels radially outward by way of central gaps, not shown, in such a way that it reaches the saw chain 16.

The lateral protrusion 66 of the stop plate 32 prevents the lubricating oil from passing axially outward through the blade 14 instead of radially wetting the saw chain 16. The tongue 68 pointing axially outward on the housing 12 for the purpose of holding the sprocket cover 26 in a rotationally secure manner is also shown.

Figure 18:
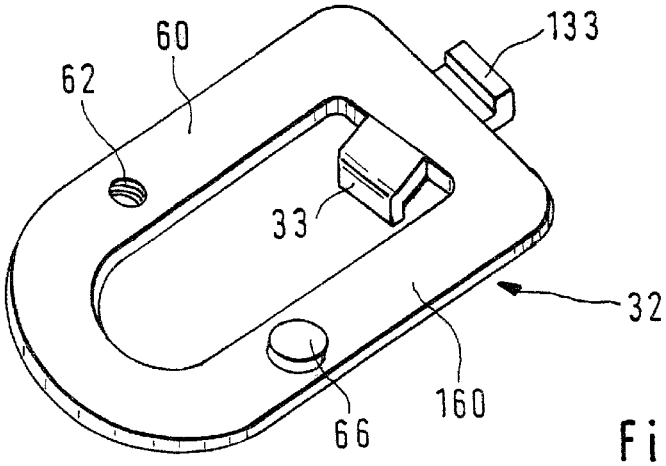
FIG. 18 shows the stop plate as an individual component

FIG. 18 shows a three-dimensional depiction of the oblong annular stop plate 32 from its side associated with the blade 14. In this instance, the stamped rear side of the protrusion 66 and the threaded hole 60 are shown particularly clearly. The other details mentioned above are also shown, but need not be discussed again in detail.

What is claimed is:

1. A motorized chainsaw (10) with a housing (12), a sprocket (22) mounted thereon, and a blade (14) aligned with the sprocket, which blade protrudes beyond the housing (12) and guides a saw chain (16) engaged with the sprocket (22) in a revolving manner, where the blade (14) is mounted such that it is adjustable by means of longitudinal displacement in relation to an element selected from the group consisting of the housing (12) and the sprocket (22) by means of a chain tensioning device (28) and where the chain tensioning device (28) has a stop (32) that is fixable to the blade (14) and a cam (30) that is rotatable by means of a rotational member (36, 38), characterized in that the cam (30) is lockable in a form-fitting and non-rotational manner in relation to the housing (12) by means of the rotational member (36, 38), that the rotational member (36, 38) is comprised of two handwheels that nest one inside the other as an inner and outer handwheel and rotatable in relation to one another around a common axis, that the inner handwheel (38) is movable axially in relation to the housing (12) and is supported on the blade (14), and that the outer handwheel (36) is coupled to the cam (30) in a rotary driving manner.

2. The motorized chainsaw according to claim 1, characterized in that the cam (30) is mounted such that it is axially and elastically displaceable in relation to the housing (12) or the outer handwheel (36).

3. The motorized chainsaw according to claim 1, characterized in that the detent coupling (27; 46; 47) is embodied as a radial detent coupling and fixable in a form-fitting fashion by means of the inner handwheel (38).

4. The motorized chainsaw according to claim 1, characterized in that the inner handwheel (38) is detachably coupled to the outer handwheel (36) by way of an axial detent coupling (41, 42, 44).

5. The motorized chainsaw according to claim 1, characterized in that spring means (40) disposed between the inner handwheel (38) and the outer handwheel (36), seek to push these handwheels away from each other in the axial direction.

6. The motorized chainsaw according to claim 1, characterized in that spring means (48) disposed between the cam (30) and the inner handwheel (38), seek to push these parts away from each other in the axial direction.

7. A chain tensioning device for a motorized chainsaw (10) according to claim 1, characterized in that a stop plate forms the stop (32) for changing the cam (30), which stop plate is fastened to the blade, is embodied in the shape of an elongated ring.

8. A motorized chainsaw (10) with a housing (12), a sprocket (22) mounted thereon, and a blade (14) aligned with the sprocket, which blade protrudes beyond the housing (12) and guides a saw chain (16) engaged with the sprocket (22) in a revolving manner, where the blade (14) is mounted such that it is adjustable by means of longitudinal displacement in relation to an element selected from the group consisting of the housing (12) and the sprocket (22) by means of a chain tensioning device (28) and where the chain tensioning device (28) has a stop (32) that is fixable to the blade (14) and a cam (30) that is rotatable by means of a rotational member (36, 38), characterized in that the cam (30) is lockable in a form-fitting and non-rotational manner in relation to the housing (12) by means of the rotational member (36, 38) comprising two handwheels that nest one inside the other as an inner and outer handwheel and rotatable in relation to one another around a common axis, and that a detent coupling (27; 46; 47) couples the outer handwheel (36), in relation to an element selected from the group consisting of the housing (12) and a sprocket cover (26).

* * * * *